US005611409A

United States Patent [19]

Arseneau

[11] Patent Number: 5,611,409

[45] Date of Patent: Mar. 18, 1997

[54] EXHAUST MUFFLER FOR SMALL INTERNAL COMBUSTION ENGINE

[76] Inventor: Michel Arseneau, 769 rang St. Marie, St. Timothée, Québec, Canada, J0S 1X0

[21] Appl. No.: 437,665

[22] Filed: May 9, 1995

[51] Int. Cl.[6] ..... F01N 7/08

[52] U.S. Cl. ..... 181/228; 181/243; 181/255; 181/404

[58] Field of Search ..... 181/227, 228, 181/240, 241, 243, 255, 268, 269, 275, 230, 404

[56] References Cited

U.S. PATENT DOCUMENTS

| | | | |
|---|---|---|---|
| 3,669,216 | 6/1972 | Spies | 181/240 |
| 3,703,037 | 11/1972 | Tenney . | |
| 3,897,854 | 8/1975 | Rhodes | 181/404 |
| 4,031,979 | 6/1977 | Raleigh | 181/240 |
| 4,046,219 | 9/1977 | Shaikh . | |
| 4,531,364 | 7/1985 | Equi . | |
| 4,858,722 | 8/1989 | Abbe et al. . | |
| 5,214,254 | 5/1993 | Sheehan | 181/241 |

*Primary Examiner*—Khanh Dang
*Attorney, Agent, or Firm*—Swabey Ogilvy Renault

[57] ABSTRACT

The exhaust muffler as a tailpipe head member including a front end mounted inside an expansion chamber of the muffler. The front end of the head member deflects exhaust gas pressure waves passing through the chamber. An annular passage is provided by the space separating the front end of the head member and the expansion chamber. A flow regulating conduit communicates exhaust gas from the annular passage to an outside of the muffler. The front portion of the expansion chamber can be provided with a series of annular flange steps for mounting onto various sizes of annular flanges of exhaust manifolds. The exhaust muffler both reduces noise levels and improves performance of the engine.

20 Claims, 2 Drawing Sheets

EXHAUST MUFFLER FOR SMALL INTERNAL COMBUSTION ENGINE

FIELD OF THE INVENTION

The present invention relates to an exhaust muffler for use with small internal combustion engines. In particular, the invention also relates to a muffler for use with small two-cycle engines.

BACKGROUND OF THE INVENTION

In the field of model aircraft exhaust mufflers, noise reduction is of particular importance to the model aircraft pilot in order to avoid creating excessive noise which may disturb residents in an area where the pilot enjoys flying his or her aircraft. It is important that such noise reduction is not provided at the cost of engine performance or the light weight of the aircraft. Model aircraft mufflers known in the art have typically been rudimentary, targeting only the basic requirement of lowering engine noise below 90 dB at 9 feet from the engine. Such an exhaust muffler kit is disclosed in U.S. Pat. No. 4,858,722 to Abbe et al.

In the area of small engine mufflers for such applications as motorcycles, snowmobiles and model vehicles, special designs have been provided to increase performance of the engine and ultimately reduce noise. Such exhaust systems are not particularly suitable for use with model aircraft due to complexity, size or configuration. For example, U.S. Pat. No. 4,531,364 to Equi discloses a compact expansion chamber for small engines of the type used on a model boat. In U.S. Pat. No. 4,046,219 to Shaikh, an exhaust muffler for a snowmobile is disclosed in which a conical expansion chamber terminates in a small end tube to which an absorptive spiral muffler unit is secured for attenuating high frequency exhaust noise. U.S. Pat. No. 3,703,937 to Tenney describes a multiple rpm range tuned exhaust pipe for two-cycle engines in which flow control is provided to vary the amount of back pressure in a manner conducive for proper engine performance in a motorcycle.

SUMMARY OF THE INVENTION

It is an object of the present invention to provide a substantially in-line exhaust muffler which significantly reduces noise levels generated by small engines.

It is another object of the present invention to provide an exhaust muffler which can be adjusted to regulate back pressure for tuning of small two-cycle engines.

It is yet another object of the present invention to provide an exhaust muffler having an inwardly tapered conical front portion provided with exterior annular flange steps for secure mounting to an annular flange of an exhaust manifold in communication with an exhaust port of the small engine so that the exhaust muffler can be mounted to a range of sizes of annular flanges of exhaust manifolds.

According to the invention, there is provided an exhaust muffler for a small engine comprising an expansion chamber in communication with an exhaust port of the engine, the chamber having an output end of reduced cross-section, and a tailpipe head member mounted at the output end of the chamber, the head member having a front end provided inside the chamber for deflecting an exhaust gas pressure wave passing through the chamber, the front end being separated from the chamber to provide a substantially annular exhaust gas passage, and a flow regulating conduit for communicating exhaust gas from the passage to an outside of the muffler. Preferably, the front end of the tailpipe head member is substantially cone shaped projecting into the chamber. The front end also preferably has acoustic ridges. The expansion chamber is preferably conically shaped with a cross section tapering towards the output end. The wall of the chamber is also preferably provided with acoustic ridges.

The flow regulating conduit preferably comprises a plurality of input orifices substantially perpendicular to a flow through the annular passage. The orifices are preferably slits which induce laminar flow. Preferably, the tailpipe head member comprises a substantially conical portion between the front end and the orifices, the conical portion tapering in a same direction as the chamber output end, and the annular space between the chamber output end and the conical portion being of substantially even thickness.

Preferably, adjustment means are included for adjustably positioning the front end of the tailpipe head member inside the expansion chamber such that a size of the annular exhaust gas passage is adjustable for adjusting a back pressure of the muffler. In this way, the muffler can be tuned for different two-cycle engines or for different operating conditions.

Also preferably, the expansion chamber comprises a tapering truncated cone shaped front portion detachably engageable with an exhaust manifold in communication with the exhaust port. Such an exhaust manifold has an annular engaging surface and the front portion of the expansion chamber is provided with a series of exterior annular flange steps for engaging any size of exhaust manifold engaging surface within a predetermined range. In this preferred arrangement, fastening means are provided for fastening the front portion of the expansion chamber to the exhaust manifold annular engaging surface. In this way, the annular flange steps improve fastening of the muffler to the manifold and also act as acoustic ridges when located inside the manifold.

BRIEF DESCRIPTION OF THE DRAWINGS

The invention will be better understood by way of the following detailed description of a preferred embodiment and other embodiments with reference to the appended drawings/in which.

DETAILED DESCRIPTION OF THE PREFERRED EMBODIMENT

Figure 1:
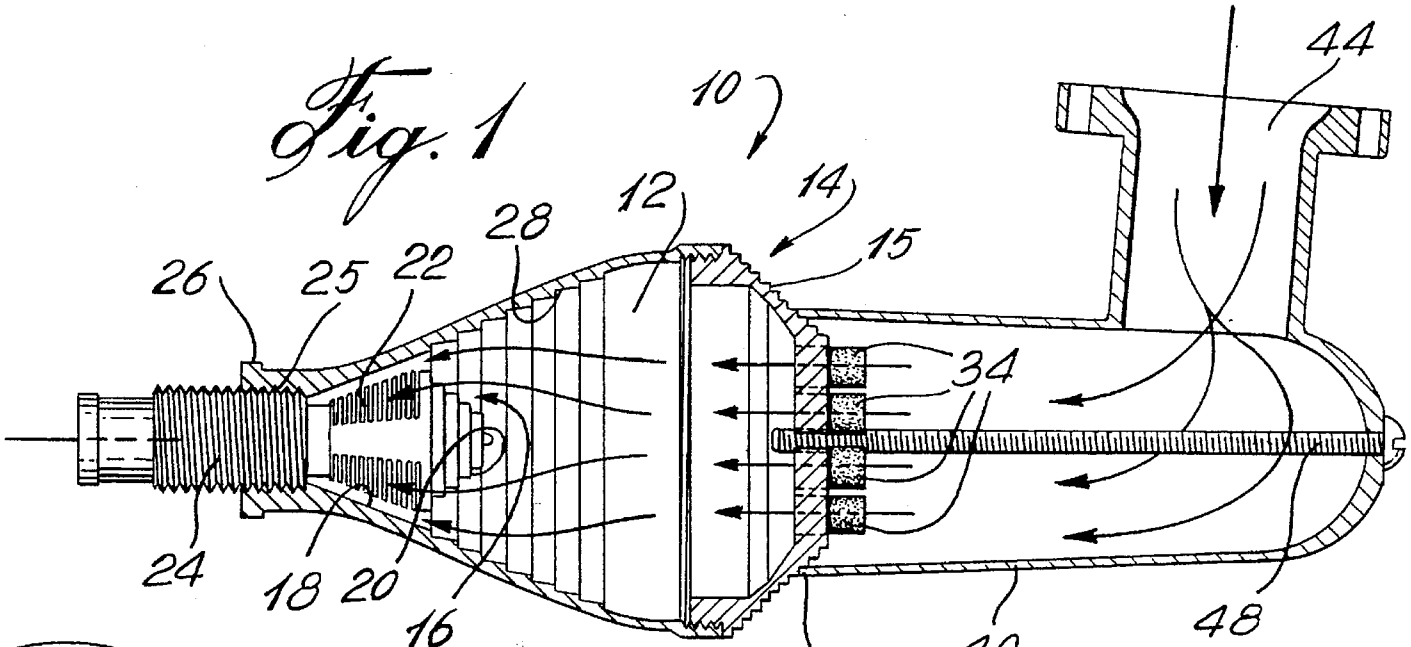
FIG. 1 is a cross-sectional view of the exhaust muffler according to the preferred embodiment as attached to an,exhaust manifold.
Figure 2:
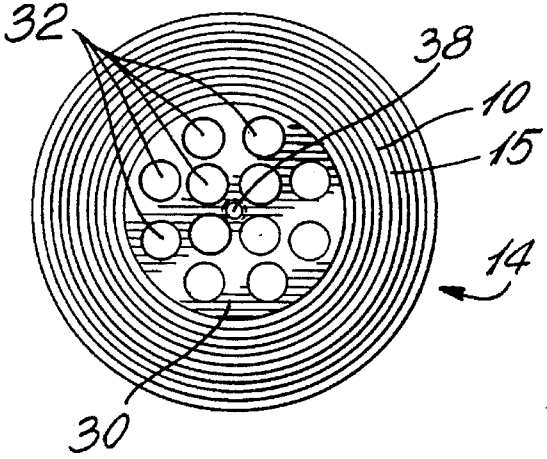
FIG. 2 is an end view of the front portion of the expansion chamber according to the preferred embodiment.

As illustrated in FIG. 1, the exhaust muffler 10 according to the preferred embodiment has an expansion chamber 12 including a front portion 14 and an output end 18. The front portion 14 is provided with annular flange steps 15 as better illustrated in FIG. 2 and includes a front disc 30 provided with a plurality of exhaust holes 32. The holes 32 are filled with neoprene tubes 34 which absorb acoustic vibrations and improve the acoustic absorbing effect of the front disc 30. The front portion 14 is mounted to the annular flange 42 of the exhaust manifold 40 by means of a threaded bolt 48. The end 44 of the exhaust manifold 40 is mounted directly to the exhaust port of a two-stroke model airplane engine as is known in the art. The exhaust gas is passed through the manifold 40 and the tubes 34 into chamber 12. Not only do the tubes 34 absorb some of the higher frequency acoustic energy present in the manifold 40, but also the annular steps 15 also act to disperse and absorb acoustic energy, especially when the annular flange 42 is larger. Chamber 12 expands at its front portion 14 and then has a conically tapered rear portion including an interior annular ridged surface 28. The ridges on surface 28 are less accentuated than the steps 15 as illustrated.

A tailpipe head member 16 has a front end 20 and a rear end 24 which optionally can be connected to a tailpipe for carrying away the muffler exhaust. In the case of a model airplane, a tailpipe for carrying away the exhaust gas is not required. The head member 16 is adjustable. Threads 25 on the cylindrical portion 24 engage with threading at the end of chamber 12 so that rotation of the member 16 can be used to adjust the position of the head member within chamber 12. A lock nut 26 is used to secure the head member 16 in place. The front end of the head member has a substantially conical stepped surface 20 which projects into chamber 12. As the acoustic energy is projected into chamber 12, the front end 20 serves to absorb acoustic energy as the exhaust gas flows through the annular passage between the front end and the output end 18 of chamber 12. A plurality of slits 22 provided in the rearwardly tapering conical portion of the head member 16 allow the exhaust gases to flow into the hollow cylinder 24 and out to the surrounding air. The plurality of slits regulate the flow and further absorb acoustic energy from the exhaust gas.

The back pressure of the exhaust muffler 10 can be adjusted by advancing the head member 16 along its axis of rotation towards the center of chamber 12. Increasing the separation between the slits 22 and the wall 18 reduces the resistance to flow and decreases the back pressure of the muffler. By adjusting the rotational position of the head member 16, the appropriate back pressure for the two-cycle engine is set to achieve the best performance.

Figure 3:
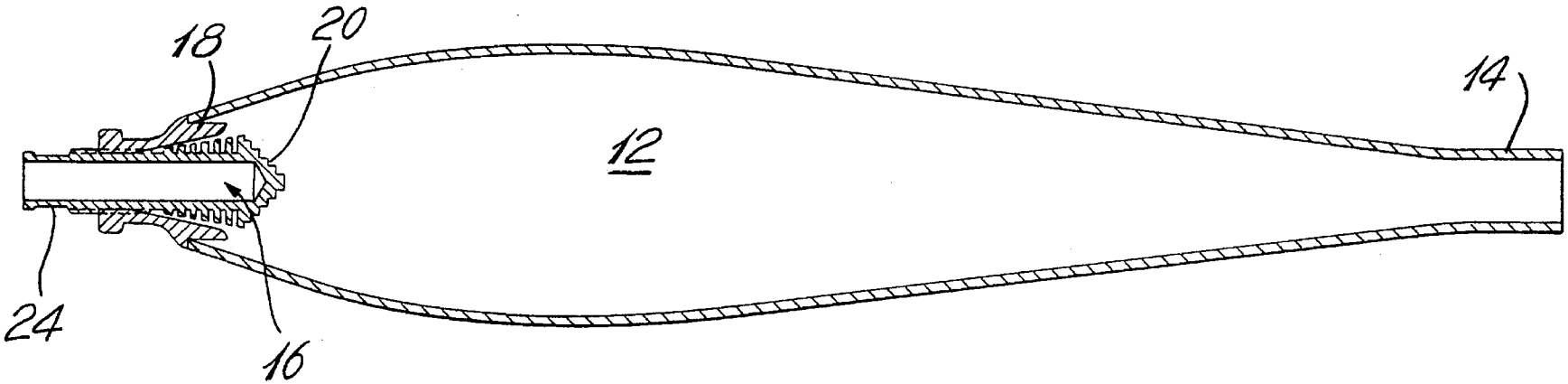
FIG. 3 is a cross-sectional view of an expansion chamber and tailpipe head member according to a further embodiment of the present invention.

The embodiment of FIG. 3 illustrates an exhaust muffler for a larger two-cycle or four-cycle engine in which the expansion chamber 12 has a substantially elongated pear shape having an inlet 14 and an outlet 18. The tailpipe head member 16 is mounted with its front end 20 inside the chamber and is adjustable as in the embodiment of FIG. 1 to control the back pressure of the muffler. The exhaust muffler illustrated in FIG. 3 does not include the typical number of baffles, spirals or turns used to adequately attenuate the acoustic energy of an engine. Such a muffler is used for high performance applications where only moderate noise reduction is required. In the preferred embodiment illustrated in FIG. 1, the muffler 10 has the advantage of further decreasing noise levels when used with larger engines having larger exhaust manifolds 40, as a result of the exhaust manifold 40 constituting a first chamber with the expansion chamber 12 constituting a second chamber separated by disc 30.

Although the invention has been described with reference to threads 25 providing the adjustability of the head member 16, it is to be understood that a variety of arrangements are possible to adjustably reduce the flow resistance passed the front 20 into the passage end out of the muffler. While the preferred embodiment illustrated has a circular cross-section, it is clear than an oval or rectangular cross-section expansion chamber may also be suitable. The "annular" passage can also thus be of an oval or rectangular shape.

I claim:

1. An exhaust muffler for a small engine producing exhaust gas, said muffler comprising:

an expansion chamber through which exhaust gas flows, said chamber having an inlet for receiving exhaust gas from said engine, said chamber having opposite said inlet an output end of reduced cross-section; and a tail pipe head member mounted at said output end of said chamber, said head member having:

a front end provided inside said chamber for deflecting an exhaust gas pressure wave passing through said chamber;

a side portion provided inside said chamber and being separated from an inner side wall of said chamber, said side portion being shaped to provide a substantially annular exhaust gas passage between said chamber side wall and said side portion, said passage having a reduced cross-section for restricting exhaust gas flow; and a flow regulating conduit for communicating exhaust gas from said side portion to an outside of said muffler, whereby exhaust gas flow through said expansion chamber, said passage and said flow regulating conduit of said tail pipe head member is substantially in-line.

2. The muffler as defined in claim 1, wherein said front end is substantially cone shaped projecting into said chamber.

3. The muffler as defined in claim 2, wherein said front end of said head member has a conical surface provided with steps for reducing noise.

4. The muffler as defined in claim 1, wherein said chamber is substantially conical, and a wall of said chamber is at least partly provided with acoustic ridges.

5. The muffler as defined in claim 2, wherein said chamber is substantially conical, and a wall of said chamber is at least partly provided with acoustic ridges.

6. The muffler as defined in claim 3, wherein said chamber is substantially conical, and a wall of said chamber is at least partly provided with acoustic ridges.

7. The muffler as defined in claim 1, wherein said flow regulating conduit comprises a plurality of orifices provided in said side portion.

8. The muffler as defined in claim 7, wherein said orifices comprise a plurality of flow regulating slits.

9. The muffler as defined in claim 7, wherein side portion is substantially conical, said side portion tapering in a same direction as said chamber output end, said annular exhaust gas passage being of substantially even thickness.

10. The muffler as defined in claim 9, wherein said orifices comprise a plurality of flow regulating slits cut into said side portion.

11. The muffler as defined in claim 9, wherein said front end is substantially cone shaped projecting into said chamber, said front end has a surface provided with steps for reducing noise.

12. The muffler as defined in claim 9, further comprising adjustment means for adjustably positioning said front end in said chamber such that a size of said annular exhaust gas passage is adjustable for adjusting a back pressure of said muffler, whereby said muffler is tunable for different two-cycle engines or different operating conditions.

13. The muffler as defined in claim 6, further comprising adjustment means for adjustably positioning said front end in said chamber such that a size of said annular exhaust gas passage is adjustable for adjusting a back pressure of said muffler, whereby said muffler is tunable for different two-cycle engines or different operating conditions.

14. The muffler as defined in claim 11, further comprising adjustment means for adjustably positioning said front end in said chamber such that a size of said annular exhaust gas passage is adjustable for adjusting a back pressure of said muffler, whereby said muffler is tunable for different two-cycle engines or different operating conditions.

15. The muffler as defined in claim 14, wherein said engine has an exhaust manifold with an annular muffler engaging surface through which said exhaust gas exits said engine, said expansion chamber comprises a tapering truncated cone-shaped front portion detachably engageable with said exhaust manifold annular engaging surface, and said front portion is provided with a series of exterior annular flange steps for engaging any size of exhaust manifold annular engaging surface within a predetermined range, further comprising means for fastening said front portion to said exhaust manifold, whereby said annular flange steps improve fastening of said muffler to said manifold and also act as acoustic ridges when located inside said manifold.

16. The muffler as defined in claim 15, wherein said front portion comprises a front disk covering a truncated apex thereof, said front disk being provided with at least one disk orifice for communicating exhaust gas from said manifold to said chamber.

17. The muffler as defined in claim 16, further comprising at least one elastomeric tube connected to said at least one disk orifice, whereby said tube absorbs sound waves as said exhaust gas pulsates through said disk orifice.

18. An exhaust muffler for a small engine producing exhaust gas and having an exhaust manifold with an annular muffler engaging surface, the muffler comprising:

an expansion chamber through which said exhaust gas flows and having an inlet in communication with said exhaust manifold, said chamber having a tapering truncated cone-shaped front portion which includes said inlet and is detachably engageable with said exhaust manifold annular engaging surface, said front portion being provided with a series of exterior annular flange steps for engaging any size of exhaust manifold engaging surface within a predetermined range; and means for fastening said front portion to said exhaust manifold, whereby said annular flange steps improve fastening of said muffler to said manifold engaging surface and also act as acoustic ridges when located inside said manifold.

19. The muffler as defined in claim 18, wherein said front portion comprises a front disk covering a truncated apex thereof, said front disk being provided with at least one disk orifice for communicating exhaust gas from said manifold to said chamber.

20. The muffler as defined in claim 19, further comprising at least one elastomeric tube connected to said at least one disk orifice, whereby said tube absorbs sound waves as said exhaust gas pulsates through said disk orifice.

* * * * *